US008255074B2

(12) United States Patent
Meissen et al.

(10) Patent No.: US 8,255,074 B2
(45) Date of Patent: Aug. 28, 2012

(54) ADAPTATION OF A CONTROLLER IN A ROLLING MILL BASED ON THE VARIATION OF AN ACTUAL VALUE OF A ROLLING PRODUCT

(75) Inventors: Reinhard Meissen, Dormitz (DE); Martin Niemann, Erlangen (DE); Wilfried Tautz, Forchheim (DE); Heinz Wilharm, Erlangen (DE); Dietrich Wohld, Rauschenberg (DE)

(73) Assignee: Siemens Aktiengesellschaft, Munich (DE)

( * ) Notice: Subject to any disclaimer, the term of this patent is extended or adjusted under 35 U.S.C. 154(b) by 178 days.

(21) Appl. No.: 12/738,932

(22) PCT Filed: Sep. 5, 2008

(86) PCT No.: PCT/EP2008/061794

§ 371 (c)(1),
(2), (4) Date: Apr. 20, 2010

(87) PCT Pub. No.: WO2009/053144

PCT Pub. Date: Apr. 30, 2009

(65) Prior Publication Data

US 2010/0211209 A1 Aug. 19, 2010

(30) Foreign Application Priority Data

Oct. 24, 2007 (DE) ..... 10 2007 050 891

(51) Int. Cl.

| | |
|---|---|
| ***G06F 19/00*** | (2006.01) |
| ***G06F 15/18*** | (2006.01) |
| ***G05B 13/02*** | (2006.01) |
| ***B21B 37/58*** | (2006.01) |

(52) U.S. Cl. ..... 700/150; 700/37; 700/108; 700/173; 72/10.1; 72/14.1; 706/14

(58) Field of Classification Search ..... 700/28, 700/32, 37, 50, 108–110, 145, 148, 150, 700/152–154, 159, 173, 155; 706/14, 15, 706/23; 72/6.1, 6.2, 7.1, 7.2, 7.4–7.6, 11.1–11.7, 72/13.4, 14.1, 14.4, 9.1, 9.5, 10.1, 12.1
See application file for complete search history.

(56) References Cited

U.S. PATENT DOCUMENTS 4,813,256 A * 3/1989 Engel ..... 72/13.4

(Continued)

FOREIGN PATENT DOCUMENTS

DE 4416364 11/1994

(Continued)

OTHER PUBLICATIONS

Ge Iusheng et al., "Prediction of Hot Rolling Machine Running States Based on Neural Network", 2006 IEEE International Conference on Industrial Informatics, 2006, pp. 242-245.*

(Continued)

*Primary Examiner* — Crystal J Barnes-Bullock
(74) *Attorney, Agent, or Firm* — King & Spalding L.L.P.

(57) ABSTRACT

During operation of a rolling mill, a rolling product running through the mill is machined by a machining device which is controlled by a controller, to which a target and an actual value of the roll product are fed after machining. The controller determines based on the target and the actual value, in conjunction with controller characteristic, a controlled variable for the machining device and outputs the controlled variable to the machining device which machines the roll product according to the output controlled variable. A detection device receives the actual value after machining and a corresponding actual value of the mill product before machining. Based on the temporal profiles of the actual values, the device dynamically determines the controller characteristic such that the variance of the actual value at least tends to be minimized after machining. The device also parameterizes the controller according to the determined control characteristic.

12 Claims, 3 Drawing Sheets

U.S. PATENT DOCUMENTS

| | | | | |
|---|---|---|---|---|
| 5,159,660 | A * | 10/1992 | Lu et al. | 706/23 |
| 5,513,097 | A | 4/1996 | Gramckow et al. | 364/148 |
| 6,055,524 | A * | 4/2000 | Cheng | 706/23 |
| 6,068,059 | A * | 5/2000 | Bajema et al. | 171/130 |
| 6,085,183 | A * | 7/2000 | Horn et al. | 706/45 |
| 6,176,112 | B1 * | 1/2001 | Sykosch et al. | 72/11.4 |
| 6,810,812 | B2 * | 11/2004 | Fischer | 101/485 |
| 6,845,283 | B2 * | 1/2005 | Popp et al. | 700/130 |
| 6,983,631 | B2 * | 1/2006 | Seidel | 72/7.6 |
| 7,050,875 | B2 * | 5/2006 | Cribbs et al. | 700/110 |
| 7,086,260 | B2 * | 8/2006 | Abi-Karam | 72/10.2 |
| 7,127,951 | B2 * | 10/2006 | Sartain et al. | 73/818 |
| 7,617,711 | B2 * | 11/2009 | Palzer et al. | 72/205 |
| 8,050,792 | B2 * | 11/2011 | Bergsten | 700/154 |
| 2008/0004722 | A1 * | 1/2008 | Al-Attar et al. | 700/50 |

FOREIGN PATENT DOCUMENTS

| | | |
|---|---|---|
| DE | 10327663 | 1/2005 |
| WO | 2005072886 | 8/2005 |

OTHER PUBLICATIONS

Jelali ,"Performance Assessment of Control Systems in Rolling Mills—Application to Strip Thickness and Flatness Control", Journal of Process Control 17 (2007) S. 805-816 Magazine (12 pages), Mar. 3, 2007.

Jelali , "Control Performance Monitoriing in the Metal Industry Part 1: Classification and Description of Methods", Automatisierungstechnik 54 (2006) 1, S. 36-46; Magazine. (12 Pages), Jan. 1, 2006.

Jelali , "An Overview of Control Performance Assessment Technology and Industrial Applications", Control Engineering Practice 14 (2006) S 441-466; Magazine (26 Pages), Nov. 18, 2005.

* cited by examiner

ADAPTATION OF A CONTROLLER IN A ROLLING MILL BASED ON THE VARIATION OF AN ACTUAL VALUE OF A ROLLING PRODUCT

CROSS-REFERENCE TO RELATED APPLICATIONS

This application is a U.S. National Stage Application of International Application No. PCT/EP2008/061794 filed Sep. 5, 2008, which designates the United States of America, and claims priority to German Application No. 10 2007 05.5 filed Oct. 24, 2007, the contents of which are hereby incorporated by reference in their entirety.

TECHNICAL FIELD

The present invention relates to an operating method for a determining device attached to a rolling mill.

The present invention further relates to an operating program that comprises machine code, the effect of whose execution by a determining device attached to a rolling mill is that the determining device executes such an operating method. The present invention further relates to a data medium on which such an operating program is stored in machine-readable form. The present invention further relates to a determining device that is attached to the rolling mill and is programmed with such an operating program. Finally, the present invention relates to a rolling mill.

BACKGROUND

The goal of any technical process is to produce a product that has specific properties. In the ideal case, the product hereby has exactly the specific properties. In practice, the properties of the product can, however, deviate from the desired properties by specific tolerance bands. Depending on the situation of the individual case, the permissible tolerance bands can be determined here by the later use and/or further processing of the product as such by—more or less arbitrary—stipulations of the customer for the product or by law.

There can be multifarious causes of the deviation of the actual properties (actual variables) from the desired properties (setpoint variables). For example, the production process can be subjected to disturbances. Again, the deviation of the actual variables from the setpoint variables can possibly be ascribed to inhomogeneous material properties or interventions by an automation device in the production process.

The general statements above are also valid specifically for the machining of a rolling stock in a rolling mill. The machining corresponds in general here to a rolling of the rolling stock, that is to say a reduction in the cross section thereof in a rolling stand. In exceptional cases, however, other types of treatment also come into consideration, for example, heat treatment in a cooling line that is arranged downstream of a rolling train.

Examples of desired properties of a rolling stock are

- in the case of a strip-shaped rolling stock, its thickness, to a lesser extent its width and the flatness of the rolling stock,
- in the case of a bar-shaped rolling stock, its height and width, in some cases also the ratio of height to width (height and width are orientated orthogonal to one another in this case),
- the tension prevailing in the rolling stock and the microstructural properties, independently of the cross section of the rolling stock. In particular the microstructure determines the later processing possibilities, for example the deep-drawing property of sheet metal. The microstructure is particularly strongly influenced by the heat treatment in the cooling line.

Rolling mills of the prior art have a basic automation and technical controls. The basic automation comprises, in particular, individual controls, for example for a rotational speed of a drive motor of a rolling stand, or a lift height of a loop lifter by means of which the tension is set to a desired tension. The technical controls comprise superimposed controllers. They determine the desired values for the basic automation. Examples are the determination of a desired roll gap, a desired rolling force, a desired rolling speed or a time profile of the amount of coolant which is to be applied at a specific location on the rolling stock. In the prior art, both the controllers of the basic automation and the controllers of the technical control respectively have a typical controller for the respective control task, for example a P controller, a PI controller, a PD controller, a PT1 controller, etc. Furthermore, a respective controller characteristic is determined for each controller. In the case of a PI controller, for example, the controller characteristic comprises its proportional gain and its integration time constant.

In the prior art, the type of controller and the controller characteristic are determined if possible in such a way that the respective controller controls as stably and accurately as possible. In particular, the aim is to use the technical controls to regulate and control the process in such a way that the quality-relevant variables are adhered to as well as possible. The aim here is for disruptions in the process behavior brought about by guiding interventions and disturbances, and the fluctuations that are caused thereby in the material properties after the rolling mill has been run through, to be kept as small as possible. However, in many cases it is not possible to determine the controller characteristic thus. For example, this can be caused by the fact that the instantaneously respectively optimum controller characteristic depends on the respective operating state of the rolling mill, for example on the instantaneous state of the rolling stock to be machined, or on an instantaneous speed at which the rolling stock is running through the rolling mill.

It is known in the prior art for controller parameters to be determined in rolling mills dynamically and as a function of state and for the controller parameters respectively determined to be prescribed to the controller. For example, the roll gap of a rolling stand can be controlled by a roll gap controller, the controller being parameterized as a function of the material properties (composition and cross section), as well as the temperature and the rolling stock speed.

Furthermore, it is known to determine controller parameters dynamically and adapt them appropriately to the controller. Reference may be made to DE 103 27 663 A1, by way of example.

SUMMARY

According to various embodiments, possibilities can be provided by means of which the controller adaptation can be further improved.

According to an embodiment, an operating method for a determining device attached to a rolling mill, in which during operation of the rolling mill,—a rolling stock running through the rolling mill is machined by means of a machining device,—the machining device is controlled by means of a controller,—the controller is fed a setpoint variable and an actual variable of the rolling stock after the machining by the machining device,—the controller uses the setpoint variable and the actual variable in conjunction with a controller characteristic to determine a manipulated variable for the machining device,—the controller outputs the manipulated variable to the machining device and—the machining device machines the rolling stock in accordance with the manipulated variable output to said machining device, the operating method comprises the steps of:—the determining device accepts the actual variable of the rolling stock after the machining by the machining device, and accepts a corresponding actual variable of the rolling stock before the machining by the machining device, and—the determining device uses the time profiles of the actual variables fed to it in order dynamically to determine the controller characteristic in such a way that the variance of the actual variable of the rolling stock after the machining by the machining device exhibits at least a tendency to minimization, and parameterizes the controller in accordance with the controller characteristic determined by said determining device.

According to a further embodiment, the determining device may use the time profile of the actual variable of the rolling stock after the machining by the machining device to determine a variance of the actual variable of the rolling stock after the machining by the machining device, and uses the time profile of the corresponding actual variable before the machining of the rolling stock by the machining device to determine a variance of the corresponding actual variable of the rolling stock before the machining by the machining device, and in that the determining device determines the controller characteristic with the aid of the variances determined by said determining device. According to a further embodiment, the actual variable of the rolling stock may be a dimension of the rolling stock transverse to a running direction of the rolling stock, a tension, a microstructural property, in the case of a strip-shaped rolling stock, a strip flatness, or in the case of a bar-shaped rolling stock a ratio between two mutually orthogonal dimensions of the rolling stock transverse to the running direction of the rolling stock.

According to another embodiment, an operating program may comprise machine code, the effect of whose execution by a determining device attached to a rolling mill is that the determining device executes an operating method as described above.

According to yet another embodiment, a data medium may store an operating program as described above in machine-readable form.

According to yet another embodiment, a determining device attached to a rolling mill may be programmed with an operating program as described above.

According to yet another embodiment, a rolling mill, may comprise a machining device by means of which a rolling stock running through the rolling mill is machined, and a controller, which is fed a setpoint variable and an actual variable of the rolling stock after the machining by the machining device, wherein the controller uses the setpoint variable and the actual variable in conjunction with a controller characteristic to determine a manipulated variable for the machining device, wherein the controller outputs the manipulated variable to the machining device, and the machining device machines the rolling stock in accordance with the manipulated variable output to it, and wherein attached to the rolling mill is a determining device as described above that is operated in accordance with an operating method as described above.

According to a further embodiment of the rolling mill, the rolling mill can be designed as a cold rolling mill or as a hot rolling mill for rolling metal, in particular steel. According to a further embodiment of the rolling mill, the rolling mill can be designed as a rolling mill for rolling a strip-shaped rolling stock or a bar-shaped rolling stock. According to a further embodiment of the rolling mill, the manipulated variable can be a desired tension, a desired adjustment or a desired roll gap of a rolling stand, a desired rolling force or a desired thermal influence of the rolling stock.

BRIEF DESCRIPTION OF THE DRAWINGS

Further advantages and details emerge from the following description of exemplary embodiments in conjunction with the drawings in which, in a basic representation.

DETAILED DESCRIPTION

Figure 1:
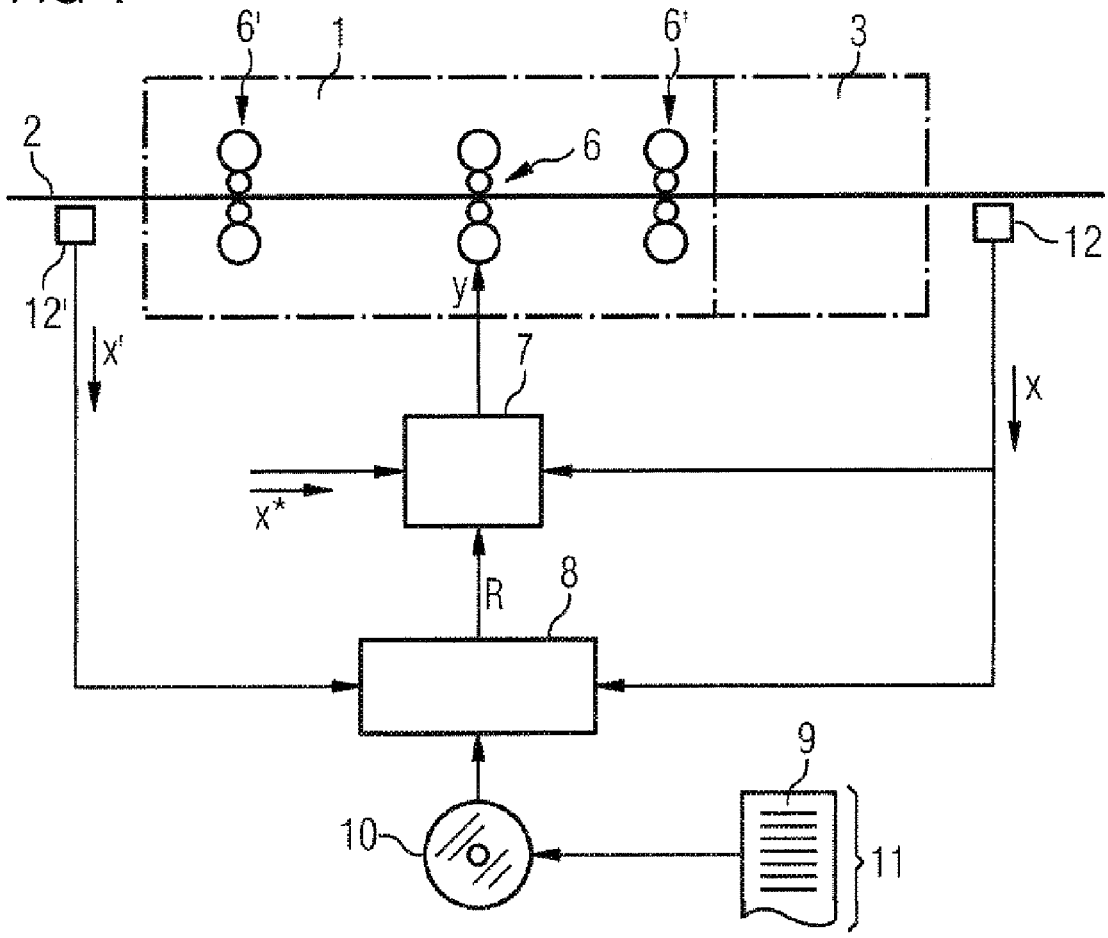
FIG. 1 is a schematic of a rolling mill.

During operation of a rolling mill, a rolling stock running through the rolling mill is machined by means of a machining device. The machining device is controlled by means of a controller. The controller is fed a setpoint variable and an actual variable of the rolling stock after the machining by the machining device. The controller uses the setpoint variable and the actual variable in conjunction with a controller characteristic to determine a manipulated variable for the machining device. The controller outputs the manipulated variable to the machining device. The machining device machines the rolling stock in accordance with the manipulated variable output to it. According to various embodiments, the actual variable of the rolling stock after the machining by the machining device, and a corresponding actual variable of the rolling stock before the machining by the machining device are fed to a determining device attached to the rolling mill. The determining device uses the time profiles of the actual variables fed to it in order dynamically to determine the controller characteristic. The determination of the controller characteristic is performed here in such a way that the variance of the actual variable of the rolling stock after the machining by the machining device exhibits at least a tendency to minimization. The determining device parameterizes the controller in accordance with the controller characteristic determined by said determining device.

The dynamic determination of the controller characteristic, and the dynamic parameterization, corresponding hereto, of the controller can be performed alternatively in real time or cyclically.

In an embodiment, the determining device uses the time profile of the actual variable of the rolling stock after the machining by the machining device to determine an appropriate variance of this actual variable, and uses the time profile of the corresponding actual variable before the machining of the rolling stock by the machining device to determine a variance of this actual variable. The determining device in this case determines the controller characteristic with the aid of the two variances determined by said determining device.

In principle, any directly or indirectly determinable property of the rolling stock comes into consideration as actual variable of the rolling stock. For example, the actual variable of the rolling stock can be a dimension of the rolling stock transverse to a running direction of the rolling stock. In the case of strip-shaped rolling stock, the strip thickness can, in particular, correspond to the actual variable. In the case of bar-shaped rolling stock, the height and the width of the rolling stock can, in particular, correspond to the actual variable. In the case of strip-shaped rolling stock, a strip flatness can, furthermore, correspond to the actual value of the rolling stock, while in the case of bar-shaped rolling stock it can be a ratio between height and width. Again, microstructural properties can be the actual variable of the rolling stock.

The rolling mill can be designed as a cold rolling mill or as a hot rolling mill for rolling metal (steel, in particular). The rolling mill can, furthermore, alternatively be designed as a rolling mill for rolling a strip-shaped or a bar-shaped rolling stock.

By analogy with the actual variable, a multiplicity of variables also come into consideration for the manipulated variable. In particular, the latter can be a desired tension, a desired adjustment or a desired roll gap of a rolling stand, a desired rolling force or a desired thermal influence of the rolling stock.

FIG. 1 is a schematic of a rolling mill. The rolling mill has at least one rolling train 1. The rolling train 1 can be designed, for example, as a single- or multi-stand roughing train, or as a single- or multi-stand finishing train. In both cases, a strip-shaped rolling stock 2 is rolled in the rolling train 1. In the case of the design as a finishing train, it is possible to arrange downstream of the rolling train 1 a cooling line 3 that is likewise seen as a component of the rolling mill within the scope of the present invention.

In the case of the design of the rolling train 1 as a roughing or finishing train, the rolling mill is designed as a hot rolling mill for rolling metal. It can, in particular, be designed as a hot rolling mill for rolling steel. As an alternative to a design of the rolling mill as a hot rolling mill, the rolling mill can, however, be designed as a cold rolling mill for cold rolling steel. In this case, the rolling train 1 is designed as a tandem train should a strip-shaped rolling stock 2 be involved.

Figure 2:
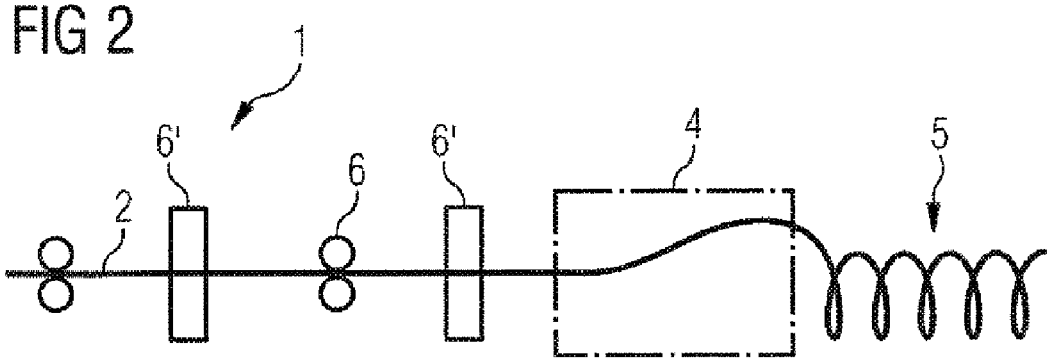
FIG. 2 is a schematic of a possible alternative refinement of the rolling mill of FIG. 1, and FIGS. 3 and 4 show two flowcharts.

In accordance with FIG. 1, a strip-shaped rolling stock 2 is rolled in the rolling mill, independently of the material of the rolling stock 2. However, this too is not mandatory. Alternatively—see FIG. 2—the rolling stock 2 can be designed as bar-shaped rolling stock 2, for example as metal wire. In this case, it is, for example, possible to arrange downstream of the rolling train a loop layer 4 that lays the rolled rolling stock 2 in loops 5. It would again alternatively be possible to design the rolling mill as a rolling mill for rolling tubular rolling stock (tubes).

In accordance with FIG. 1, the rolling mill has a machining device 6 by means of which the rolling stock 2 is machined when it runs through the rolling mill. As a rule, the machining device 6 is designed as a rolling stand 6. The machining of the rolling stock 2 therefore corresponds as a rule to a rolling process. In individual cases, the machining device 6 could, however, also be of different design. For example, it could be designed as a loop lifter by means of which the tension of the rolling stock 2 is influenced. Again, in individual cases it could be designed as a cooling line 3 by means of which the temperature of the rolling stock 2 is influenced.

The rolling mill further has at least one controller 7. Furthermore, a determining device 8 is attached to the rolling mill. The determining device 8 is designed as a software-programmable determining device 8. It is programmed by means of an operating program 9 that is fed to the determining device 8 by means of a suitable data medium 10. The operating program 9 is stored in machine-readable form on the data medium 10, for example a CD-ROM, a USB memory stick or a memory card. Said program comprises machine code 11 that can be executed by the determining device 8. The execution of the machine code 11 by the determining device 8 has the effect that during operation of the rolling mill the determining device 8 executes an operating method that is explained in more detail below in conjunction with FIGS. 1 and 3.

The determining device 8 accepts an actual variable x of the rolling stock 2 in a step S1. The actual variable x is hereby acquired, by means of a suitable acquisition device 12, at a location that is downstream of the machining device 6. The actual variable x of the rolling stock 2 is therefore an actual variable x of the rolling stock 2 after the machining by the machining device 6. The acquisition device 12 can be arranged directly downstream of the machining device 6. Alternatively, further machining devices 6', for example further rolling stands 6', can be arranged between the machining device 6 and the acquisition device 12.

The actual value x of the rolling stock 2 can alternatively be acquired directly or indirectly. One of the following variables can be involved, by way of example:

- A dimension of the rolling stock 2 transverse to a running direction of the rolling stock 2. In the case of strip-shaped rolling stock 2, this can be the thickness (normal case) or the width (exception) of the rolling stock 2. In the case of bar-shaped rolling stock 2, consideration is given alternatively or together, to the height and the width, orthogonal hereto, of the rolling stock 2 as actual variable x. In the case of bar shaped rolling stock 2, the ratio of height to width further comes into consideration as actual variable x.
- As an alternative to a dimension of the rolling stock 2, the actual variable x can be a tension prevailing in the rolling stock 2, a microstructural property or (in the case of a strip-shaped rolling stock 2) a strip flatness.

In a step S2, the determining device 8 adds the actual variable x newly accepted in step S1 to a time sequence of previously accepted actual variables x. Said determining device thereby updates a time profile of the actual variable x. If appropriate, one (or more) old, "overhauled" actual variable(s) x can be removed from the time profile in the course of step S2.

In a step S3, the determining device 8 accepts a further actual variable x'. The further actual variable x' corresponds with reference to its significance to the actual variable x, but it is acquired by means of a further acquisition device 12' at a location of the rolling mill that lies upstream of the machining device 6. The further actual variable x' is therefore an actual variable x' upstream of the machining of the rolling stock 2 by the machining device 6. The statements relating to the arrangement of the acquisition device 12 hold analogously with reference to the arrangement of the further acquisition device 12'.

In a step S4, the determining device 8 updates—in a fashion analogous to step S2—a time profile of the further actual variable x'.

In steps S5 to S7, the determining device 8 uses the time profiles of the actual variables x, x' fed to it to determine a controller characteristic R dynamically. It hereby determines the controller characteristic R in such a way that the variance of the actual variable x of the rolling stock 2 after the machining by the machining device 6 is minimized (at least in tendency). A gradual correction is to be aimed at in this case, as a rule. Finally, the determining device 8 parameterizes the controller 7 in a step S8 in accordance with the controller characteristic R determined by it.

The acquisition, explained above, of the actual variables x, x' can (but may not) be performed simultaneously. However, it is important that the time profiles of the actual variables x, x' that are used to determine the controller characteristic R correspond to one another in space, that is to say refer to the same section of the rolling stock 2 (purely by way of example: the first 20% of the rolling stock 2).

Figure 3:
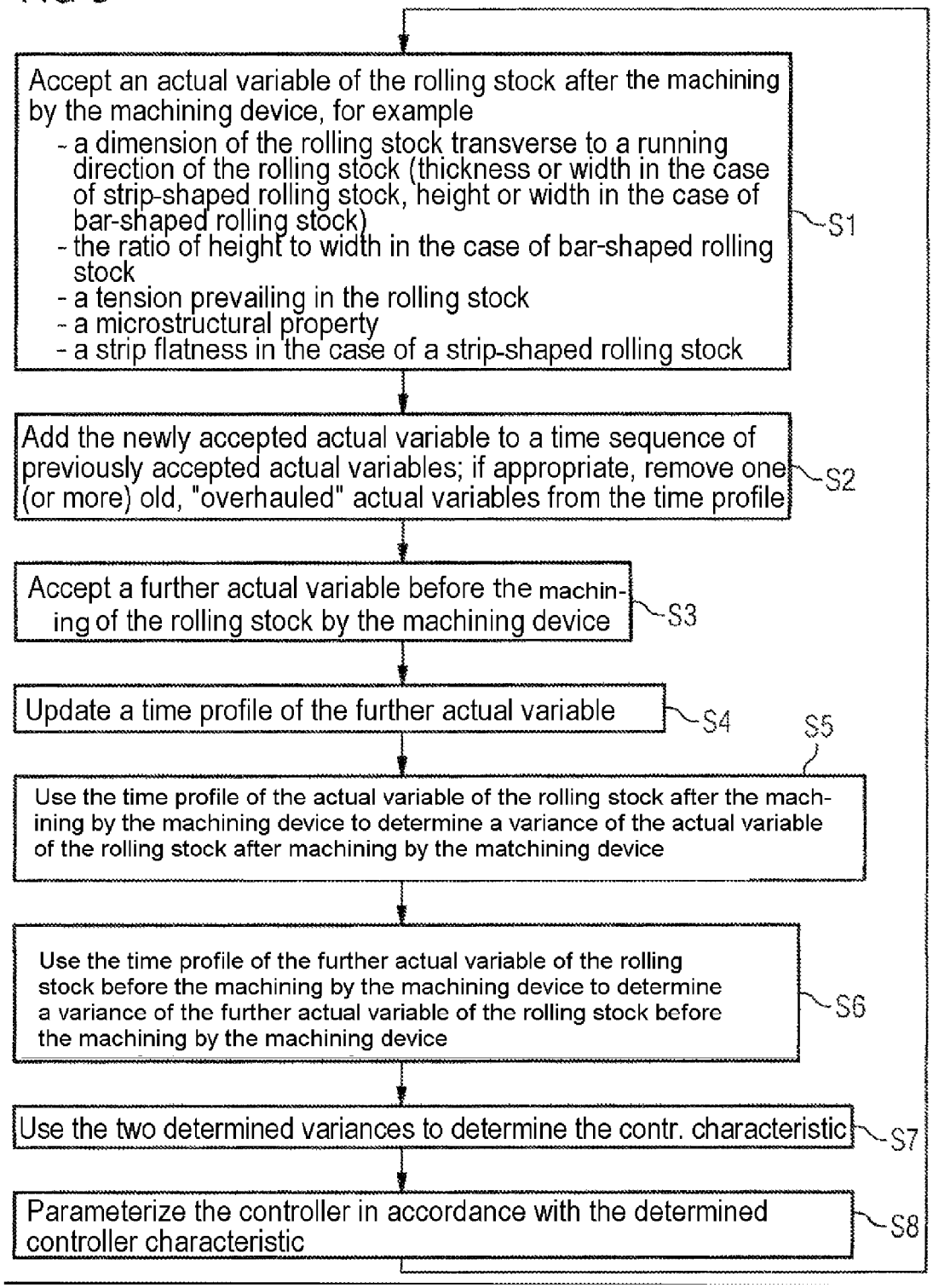

A specific refinement of the present mode of operation of the determining device 8 is already illustrated in FIG. 3. In accordance with FIG. 3, the determining device 8 firstly uses the time profile of the actual variable x of the rolling stock 2 after the machining by the machining device 6 to determine a variance of the actual variable x of the rolling stock 2 after the machining by the machining device 6 in the course of step S5. In an analogous way, the determining device 8 uses the time profile of the corresponding actual variable x' before the machining of the rolling stock 2 by the machining device 6 to determine a variance of the actual variable x' of the rolling stock 2 before the machining of the rolling stock 2 by the machining device 6. In step S7, the determining device 8 then determines the controller characteristic R with the aid of the two variances determined by said determining device.

According to various embodiments, the mean value of the acquired actual variables x and/or x' does not feature in the determination of the controller characteristic R. The point is, in particular, that any possible deviation of the mean value of the actual variable x of the rolling stock 2 after the machining by the machining device 6 can be corrected by appropriately correcting a setpoint variable x* fed to the controller 7.

During operation of the rolling mill, the controller 7 executes a control method that is explained in more detail below in conjunction with FIGS. 1 and 4.

Figure 4:
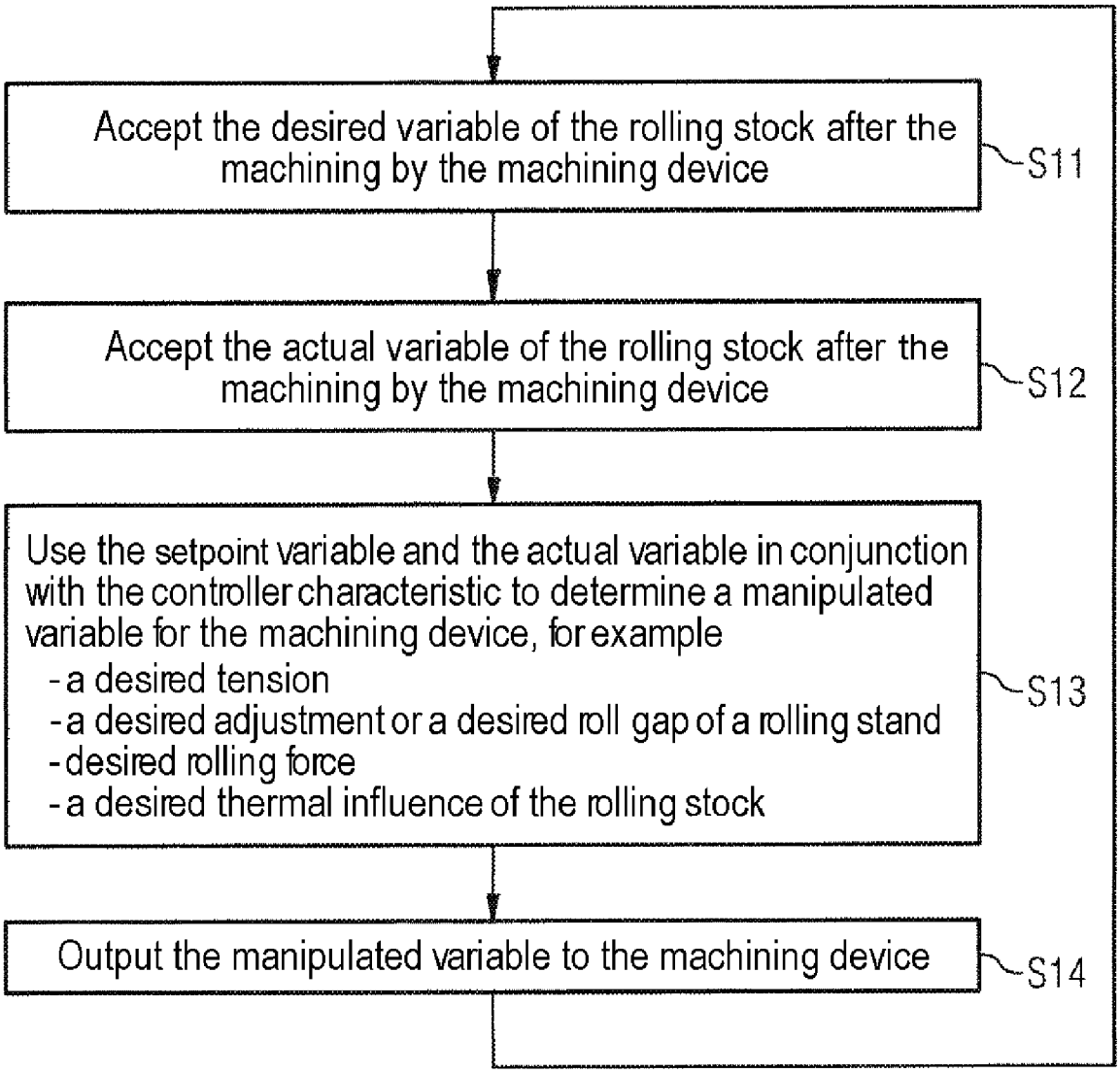

In accordance with FIG. 4, in steps S11 and S12 the controller 7 accepts the setpoint variable x* and the actual variable x of the rolling stock 2 after the machining by the machining device 6. The controller 7 uses the setpoint variable x* and the actual variable x in conjunction with the controller characteristic R to determine a manipulated variable y for the machining device 6 in a step S13. The manipulated variable y is output by the controller 7 in a step S14 to the machining device 6. The controller 7 thereby controls the machining device 6 in such a way that the machining device 6 machines the rolling stock 2 in accordance with the manipulated variable y output to it.

The manipulated variable y can be multifarious in nature. For example, the manipulated variable y can be a desired tension, a desired adjustment or a desired roll gap of a rolling stand, a desired rolling force or a desired thermal influence of the rolling stock 2.

The refinement according to various embodiments has many advantages. In particular, the determination of the controller characteristic R is performed in such a way that as large a percentage as possible of the rolling stock 2 running through the rolling mill lies within the permissible tolerance band. Furthermore, the controller 7 is adapted in such a way that it controls the machining device 6 first in a stable fashion and secondly in time optimum fashion.

The refinements according to various embodiments are to be used as required. In practice, it has proved to be particularly significant when the actual values x, x' are the strip thickness of a strip-shaped rolling stock 2 and the manipulated variable y is a desired tension to be applied to the rolling stock 2 during rolling. The present invention is not, however, restricted to this refinement.

The above description serves exclusively to explain the present invention. However, the scope of protection of the present invention is to be determined exclusively by the attached claims.

What is claimed is:

1. An operating method for a determining device attached to a rolling mill, wherein during operation of the rolling mill, a rolling stock running through the rolling mill is machined by means of a machining device, and the machining device is controlled by means of a controller, the method comprising:

generating a time profile of a pre-machining variable of the rolling stock based on a series of measurements of the rolling stock over time at a location upstream of the machining device, as the rolling stock runs through the rolling mill, generating a time profile of a post-machining variable of the rolling stock based on a series of measurements of the rolling stock over time at a location downstream of the machining device, as the rolling stock runs through the rolling mill, calculating a time-based variance of the pre-machining variable time profile representing the variability of the pre-machining variable over time, calculating a time-based variance of the post-machining variable time profile representing the variability of the post-machining variable over time, calculating a controller characteristic based on (a) the time-based variance of the pre-machining variable time profile and (b) the time-based variance of the post-machining variable time profile, the controller characteristic being configured for reducing a subsequently calculated time-based variance of the post-machining variable time profile, using at least the setpoint variable and the calculated controller characteristic to determine a manipulated variable for the machining device, outputting the manipulated variable to the machining device, and adjusting the machining of the rolling stock by the machining device in accordance with the manipulated variable output to said machining device.

2. The operating method according to claim 1, wherein:

the rolling stock is strip-shaped;

the pre-machining variable of the rolling stock is a pre-machining strip thickness of the rolling stock;

the post-machining variable of the rolling stock is a post-machining strip thickness of the rolling stock; and the manipulated variable is a tension applied to the rolling stock.

3. The operating method according to claim 1, wherein the post-machining variable of the rolling stock is selected from the group consisting of a dimension of the rolling stock transverse to a running direction of the rolling stock, a tension, a microstructural property, in the case of a strip-shaped rolling stock, a strip flatness, and a ratio between two mutually orthogonal dimensions of the rolling stock transverse to the running direction of the rolling stock.

4. An operating program product comprising a non-transitory machine readable medium that comprises machine code, which when executed by a determining device attached to a rolling mills:

generates a time profile of a pre-machining variable of the rolling stock based on a series of measurements of the rolling stock over time at a location upstream of the machining device, as the rolling stock runs through the rolling mill, generates a time profile of a post-machining variable of the rolling stock based on a series of measurements of the rolling stock over time at a location downstream of the machining device, as the rolling stock runs through the rolling mill, calculates a time-based variance of the pre-machining variable time profile representing the variability of the pre-machining variable over time, calculates a time-based variance of the post-machining variable time profile representing the variability of the post-machining variable over time, calculates a controller characteristic based on (a) the time-based variance of the pre-machining variable time profile and (b) the time-based variance of the post-machining variable time profile, the controller characteristic being configured for reducing a subsequently calculated time-based variance of the post-machining variable time profile, uses at least the setpoint variable and the calculated controller characteristic to determine a manipulated variable for the machining device, outputs the manipulated variable to the machining device, and adjusts the machining of the rolling stock by the machining device in accordance with the manipulated variable output to said machining device.

5. A determining device attached to a rolling mill, wherein during operation of the rolling mill, a rolling stock running through the rolling mill is machined by means of a machining device controlled by means of a controller, wherein the determining device is programmed to:

generate a time profile of a pre-machining variable of the rolling stock based on a series of measurements of the rolling stock over time at a location upstream of the machining device, as the rolling stock runs through the rolling mill, generate a time profile of a post-machining variable of the rolling stock based on a series of measurements of the rolling stock over time at a location downstream of the machining device, as the rolling stock runs through the rolling mill, calculate a time-based variance of the pre-machining variable time profile representing the variability of the pre-machining variable over time, calculate a time-based variance of the post-machining variable time profile representing the variability of the post-machining variable over time, and calculate a controller characteristic based on (a) the time-based variance of the pre-machining variable time profile and (b) the time-based variance of the post-machining variable time profile, the controller characteristic being configured for reducing a subsequently calculated time-based variance of the post-machining variable time profile, the controller characteristic being used by the controller for adjusting the operation of the machining device.

6. The determining device according to claim 5, wherein the post-machining variable of the rolling stock is selected from the group consisting of a dimension of the rolling stock transverse to a running direction of the rolling stock, a tension, a microstructural property, in the case of a strip-shaped rolling stock, a strip flatness, and a ratio between two mutually orthogonal dimensions of the rolling stock transverse to the running direction of the rolling stock.

7. The determining device according to claim 5, wherein:

the rolling stock is strip-shaped;

the pre-machining variable of the rolling stock is a pre-machining strip thickness of the rolling stock;

the post-machining variable of the rolling stock is a post-machining strip thickness of the rolling stock; and the manipulated variable is a tension applied to the rolling stock.

8. A rolling mill, comprising:

a machining device by means of which a rolling stock running through the rolling mill is machined, a determining device programmed to:

generate a time profile of a pre-machining variable of the rolling stock based on a series of measurements of the rolling stock over time at a location upstream of the machining device, as the rolling stock runs through the rolling mill, generate a time profile of a post-machining variable of the rolling stock based on a series of measurements of the rolling stock over time at a location downstream of the machining device, as the rolling stock runs through the rolling mill, calculate a time-based variance of the pre-machining variable time profile representing the variability of the pre-machining variable over time, calculate a time-based variance of the post-machining variable time profile representing the variability of the post-machining variable over time, and calculate a controller characteristic based on (a) the time-based variance of the pre-machining variable time profile and (b) the time-based variance of the post-machining variable time profile, the controller characteristic being configured for reducing a subsequently calculated time-based variance of the post-machining variable time profile, and a controller programmed to:

determine a manipulated variable for the machining device based on at least a setpoint variable and the calculated controller characteristic, output the manipulated variable to the machining device, such that the machining device machines the rolling stock in accordance with the manipulated variable output to it.

9. A rolling mill according to claim 8, wherein the rolling mill is designed as a cold rolling mill or as a hot rolling mill for rolling metal.

10. The rolling mill according to claim 8, wherein the rolling mill is designed as a rolling mill for rolling a strip-shaped rolling stock or a bar-shaped rolling stock.

11. The rolling mill according to claim 8, wherein the manipulated variable is selected from the group consisting of a desired tension, a desired adjustment or a desired roll gap of a rolling stand, a desired rolling force or a desired thermal influence of the rolling stock.

12. The rolling mine according to claim 8, wherein the post-machining variable of the rolling stock is selected from the group consisting of a dimension of the rolling stock transverse to a running direction of the rolling stock, a tension, a microstructural property, in the case of a strip-shaped rolling stock, a strip flatness, and a ratio between two mutually orthogonal dimensions of the rolling stock transverse to the running direction of the rolling stock.

* * * * *